United States Patent [19]

Lindblom

[11] Patent Number: 4,687,678

[45] Date of Patent: Aug. 18, 1987

[54] PROCESS FOR PREPARING HIGH TEMPERATURE MATERIALS

[76] Inventor: Yngve S. Lindblom, Konvaljegatan 6, S-582 46 Linköping, Sweden

[21] Appl. No.: 822,425

[22] PCT Filed: Mar. 29, 1985

[86] PCT No.: PCT/SE85/00148

§ 371 Date: Nov. 25, 1985

§ 102(e) Date: Nov. 25, 1985

[87] PCT Pub. No.: WO85/04428

PCT Pub. Date: Oct. 10, 1985

[30] Foreign Application Priority Data

Mar. 30, 1984 [SE] Sweden ..... 8401757

[51] Int. Cl.[4] ..... B05D 1/08

[52] U.S. Cl. ..... 427/34; 427/423

[58] Field of Search ..... 427/34, 423; 428/678

[56] References Cited

U.S. PATENT DOCUMENTS 4,095,003 6/1978 Weatherly et al. ..... 427/34
4,145,481 3/1979 Gupta et al. ..... 427/34
4,198,442 4/1980 Gupta et al. ..... 427/423
4,248,940 2/1981 Goward et al. ..... 427/34
4,275,090 6/1981 McComas et al. ..... 427/34
4,411,936 10/1983 Schrewelius ..... 427/423

FOREIGN PATENT DOCUMENTS 8007678 5/1982 Sweden .
2025469 1/1980 United Kingdom .

*Primary Examiner*—John H. Newsome
*Attorney, Agent, or Firm*—Fleit, Jacobson, Cohn & Price

[57] ABSTRACT

Production of high temperature materials with coatings being resistant to high temperature corrosion by forming a dual phase structure of corrosion resistant metal alloy and metal oxides. The metal oxides function as barriers for the diffusion of alloy elements, heat diffusion and electric conductivity. The result can be further enhanced by hot isostatic pressing of the coating and the use of tantalum as barrier layer, where the functioning of tantalum is the result of the low diffusion speed of tantalum in nickel base alloys.

11 Claims, 6 Drawing Figures

PROCESS FOR PREPARING HIGH TEMPERATURE MATERIALS

In the field of gas turbines the development is characterized by increased engine temperatures. This development has made it necessary to change the composition of for instance nickel base alloys towards lower contents of oxidation resistant elements like chromium and higher contents of high temperature strengthening $\gamma'$-forming elements like aluminium. The resistance against high temperature corrosion in the low chromium nickel base alloys has then been maintained by coating the components for increased oxidation resistance. The most common type of coating has been nickel aluminide with additions of chromium, silicon and sometimes platinum. The coating is obtained by forming an aluminium layer on the base material by chemical vapour deposition, and forming the nickel aluminide by a subsequent diffusion heat treatment.

A later development has been to build up "overlay coatings" by physical vapour deposition, plasma spraying or vacuum plasma spraying. These types of coatings are often called MCrAlY:s after the elements in the composition, where M can be Fe, Ni, Co or NiCo.

The expression MCrAlY only refers to the chemical composition, not to thermodynamical phase composition of the coatings. FeCrAlY has a ferritic body centered cubic (bcc) crystal structure which is ductile, the others a face centered (fcc) intermetallic cubic structure which is brittle in comparison.

Of the above mentioned methods of deposition, physical vapour deposition is generally considered to be the most expensive method and ordinary plasma spraying the cheapest. Ordinary plasma spraying has up to now not been used so frequently as other methods in spite of the cost factor, because the oxides formed are considered to be detrimental to the properties of the coating. This has been one of the reasons behind the development of the vacuum plasma process intended to give an oxide free coating.

Of the coating compositions mentioned above, FeCrAlY is known since the 1930:s under the designation "Kanthal", the others have been developed later on.

The present invention, which is of interest for aircraft engines and gas turbines, differs from conventional coating in the way that instead of trying to avoid oxides more or less unintentionally formed during coating and considered detrimental, a coating is intentionally formed consisting of a mixture of oxide- and metal phase particles, which by subsequent treatments is turned to a coating with properties equal or superior to those of a pure metallic coating with the same metal phase composition both with regard to hot corrosion and to heat conducting properties. The characteristics of the invention are evident from the attached patent claims. Rig tests as shown in FIG. 3 confirm that the object of the invention has been reached. The tests also confirm that the low alloy cost plasma sprayed FeCrAlY under these circumstances is quite comparable if not superior to the high alloy cost vacuum plasma sprayed CoCrAlY. As the bodycentered cubic FeCrAlY-coating is more ductile that the facecentered intermetallic cubic coatings, it can also serve as underlay coating for ceramic coatings with the advantage that the coefficient of expansion is more than 30% lower than for a face centered cubic coating and nearer the coefficient of expansion for ceramics. The ductility of FeCrAlY is also an advantage with regard to resistance against thermal fatigue in the matrix-coating-ceramic interfaces.

Coatings on high temperature alloys are slowly consumed by diffusion of metal atoms from the interior matrix-coating interface inwards and outwards and from oxygen and sulphur from the exterior atmosphere inwards. The efficiency of a coating can be judged by the time it takes until the coating shows signs of penetration as shown in FIG. 3.

The life requirements vary among other things with the times between engine overhauls, which can be 200–600 hrs for military jet engines up to 3000 hrs for civil jet engines and even longer for stationary gas turbines.

The diffusion of metal atoms from a nickel base alloy into an overlay CoCrAlY-NiCrAlY type of coating will generally not change the crystallographic structure of the coating. If nickel however is allowed to diffuse into a ferritic FeCrAlY coating, a phase change from bcc to fcc occurs and the coating losses ductility. Oxide layers parallel to the matrix surface form obstacles to the diffusion of nickel atoms and delay the transformation from bcc to fcc structure.

The coating of a matrix metal, for instance a nickel base alloy by physical vapour deposition results in an epitaxial growth (at right angle to the surface). The structure obtained contains long porosities so called "leaders" going from the interface of matrix-coating outwards. These leaders increase the diffusion rate of oxygen and sulphur from the combustion gases inwards to the matrix metal. A plasma spayed coating also contains pores but in this case more equiaxed. In both cases a closing of pores reduces the oxidation and sulphidation rate of the coatings. A closing of pores is necessary for the dual phase metal-metal oxide coating to work. FIG. 1 and FIG. 2 show that a closing of pores is possible without any essential deterioration of the morphology of the oxides. Some phase changes occur in the coating-matrix interface due to diffusion during the closing process. The closing process benefits if it can be performed at temperatures under 1000° C. or lower.

During ordinary plasma spraying (not vacuum plasma spraying) aluminium, yttrium and chromium in the powder are oxidized. The composition of the metal powder must be adapted with regard to the oxidized elements so that the composition of the metal phase in the finished coating corresponds to the composition of the alloy with maximum corrosion resistance. This requires at least 2% aluminium more in the metal powder than in the coating metal phase. A typical FeCrAlY composition is Fe balance, 20% Cr, 9% Al and 1.5% Y. The content of metal oxide in the coating can be varied by having more or less oxygen gas in the plasma or by mixing ceramic particles into the plasma powder.

The object of the invention is to increase the usable life time and to minimize the costs of high temperature resistant coatings. This is being done by a series of moves intended to reduce detrimental diffusion without serious loss of mechanical properties in the system or unreasonable increase in costs. If the moves mentioned are not sufficient for the required service life, the coating can be improved by introducing yet another metal diffusion barrier namely a tantalum layer between the matrix and the FeCrAlY coating. Investigations on the alloy IN 738 have shown that when homogenizing the alloy the diffution of tantalum is small. Tantalum forms high temperature stable intermetallic compounds or mixtures with all the elements Al, Co, Fe, Ni, Cr, Y and is especially suitable to prevent diffusion from the FeCrAlY into a cobalt or nickel base alloy or vice versa. To sum up the different steps in obtaining an improved high temperature coating to low costs, these are:

the metallic coating is substituted by a metal-metal oxide dual phase metal-ceramic coating applied by plasma spraying. The morphology of the ceramics is such as to increase metal atom diffusion distances from the coating-matrix interface to the surface of the component.

the above principle works for all MCrAlY-coatings but use of the ductile ferritic FeCrAlY alloy makes it possible to mix more oxides into the coating, increasing diffusion distances even more, without getting a too brittle coating, too susceptible to thermal fatique.

the possibility of diffusion of oxygen and sulphur through the coating are reduced by closing the pores inside the coating. These pores have been formed during plasma spraying. The pores can hardly be avoided in a dual metal-metal oxide coating applied by plasma spraying. Closing can be obtained by hot isostatic pressing, but other mechanical methods are also possible.

a reduction of the possibilities of metal atoms to diffuse from the matrix metal into the FeCrAlY, thereby changing the phase structure from bcc to the more brittle fcc, can further be obtained by introducing a layer of tantalum between the matrix and the FeCrAlY coating. This will improve the mechanical properties of the coating especially with regard to thermal fatique. With regard to diffusion of metals, tantalum also works for the other MCrAlY:s, but the benefit is probably not as great.

all the above operations mentioned will contribute to a step-wise increase in service life expectancy of the coating. Costs versus life expectancy will decide the necessity of a tantalum layer.

the low costs are obtained by using a simple method, plasma spraying, for application of the coating, and a metal phase FeCrAlY with low costs in alloying elements.

the compatibility towards ceramic coatings with regard to lower coefficient of expansion both for the metal-oxide phase and the bcc FeCrAlY-metal compared to the fcc-MCrAlY:s, and the good ductility of FeCrAlY improves the life time expectancy for ceramic coatings with the improved FeCrAlY coating as underlay.

The advantages of the invention are illustraed in more detail in the attached photos and diagrams, in which FIG. 1 shows a plasma sprayed FeCrAlY coating with oxide inclusion;

Figure 1:
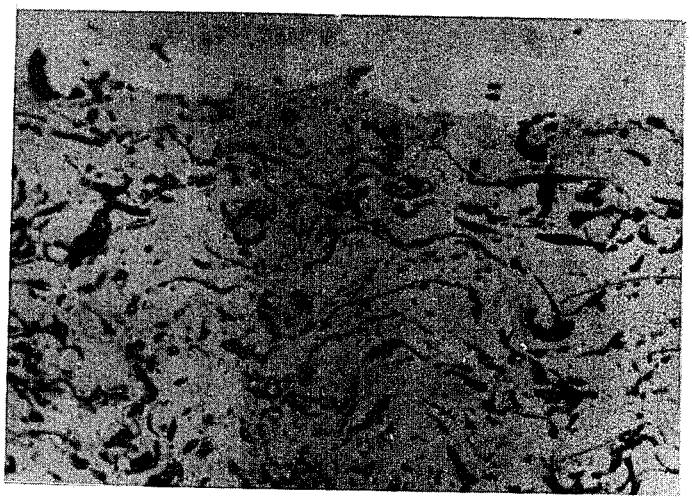

In FIG. 1 is shown an air plasma sprayed, APS, FeCrAlY coating. When using this coating method oxide particles with lenticular shape are formed. The oxide is developed around the droplets as they fly between the spray gun and the specimen. The droplets splat out when impinging upon the surface, i.e., the heat input is high enough. Thus, the oxides less than 1 micron thick will become preferentially oriented with their flat sides parallel to the substrate which is shown in FIG. 1. Metal atoms diffusing into the coating from the substrate have to pass around the oxides and thereby the diffusion times for penetratin of the coating for metal atoms from the substrate is increased.

When using physical vapor deposition, PVD, as a coating method the film consists of densely packed fibers or fine columns oriented perpendicular to the substrate surface. The structure obtained contains elongated pores which are called "leaders". Unless sealed, these leaders increase the diffusion rate of oxygen and sulfur from the combustion gases into the matrix metal. An air plasma sprayed coating also contains pores, but in this case, as mentioned before, the longitudinal direction of pores is parallel to the surface. In both cases closing the pores by hot isostatic pressing, HIP, reduces the oxidation and sulphidation rates of the coatings.

Figure 2:
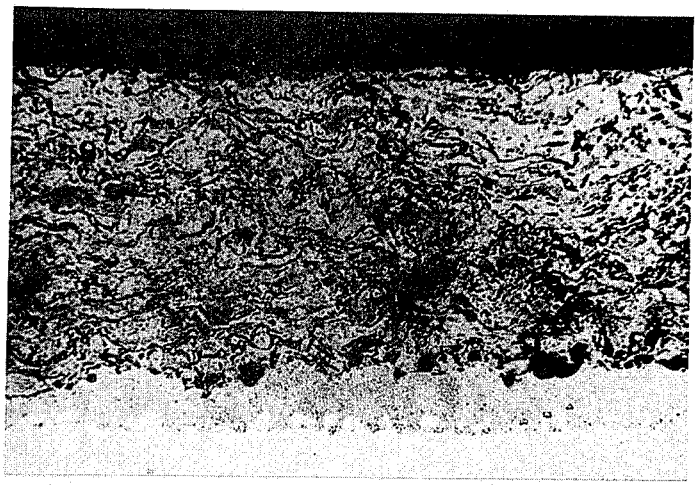
FIG. 2 shows the coating of FIG. 1 after mechanical closing of pores.
Figure 3:
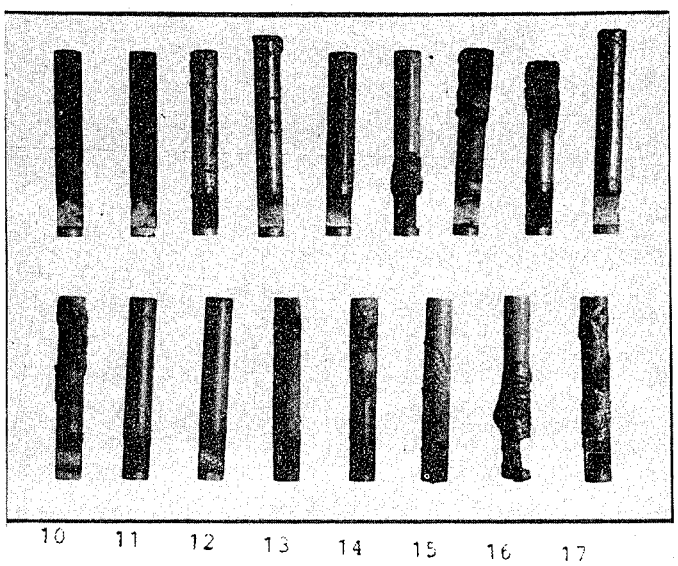
FIG. 3 shows the results of rig tests.

FIG. 2 shows that closing the pores by HIP is possible without any essential deterioration of the orientation and morphology of the oxides and FIG. 3 confirms that the goal of increasing the corrosion resistance in the described way has been reached. The corrosion testing has been performed in a burner rig at National Physical Laboratories, NPL, Teddington, England, within the framework of the E.G. Cost 50 exercise, where a variety of coatings have been compared. Specimen 11, FeCrAlY with 6% Al air plasma sprayed and hipped, and specimen 12, air plasma sprayed FeCrAlY with 12% Al and hipped, have performed in a satisfactory way showing equal performance as the low pressure plasma sprayed CoCrAlY coatings shown in specimen 1 and 2.

Regarding FIG. 2, the diffusion zone that has been formed when hipping the specimen should be noted. The big oxides at the interface area gritblasting alumina residues and FIG. 2 shows that at the original substrate-coating interface diffusion seems to go from the coating into the substrate rather than the opposite way.

The role of tantalum as a barrier to diffusion is not caused by the metal itself, but by the intermetallic compounds formed with Fe, Ni, Co, Cr etc., which all are high temperature stable compounds as can be found in binary phase diagram books.

Figure 4:
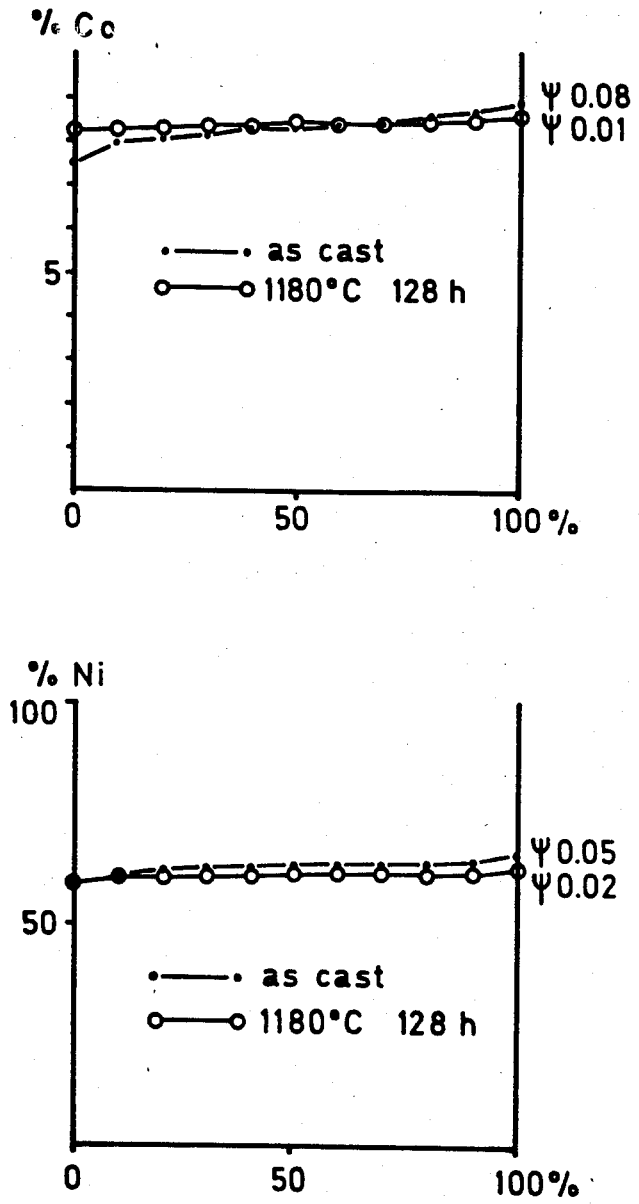
FIGS. 4–6 are diagrams showing cumulative frequencies of alloying elements after homogenizing of the alloy IN 738 at 1180° C. for 128 hours. Random scanning 100 points.
Figure 5:
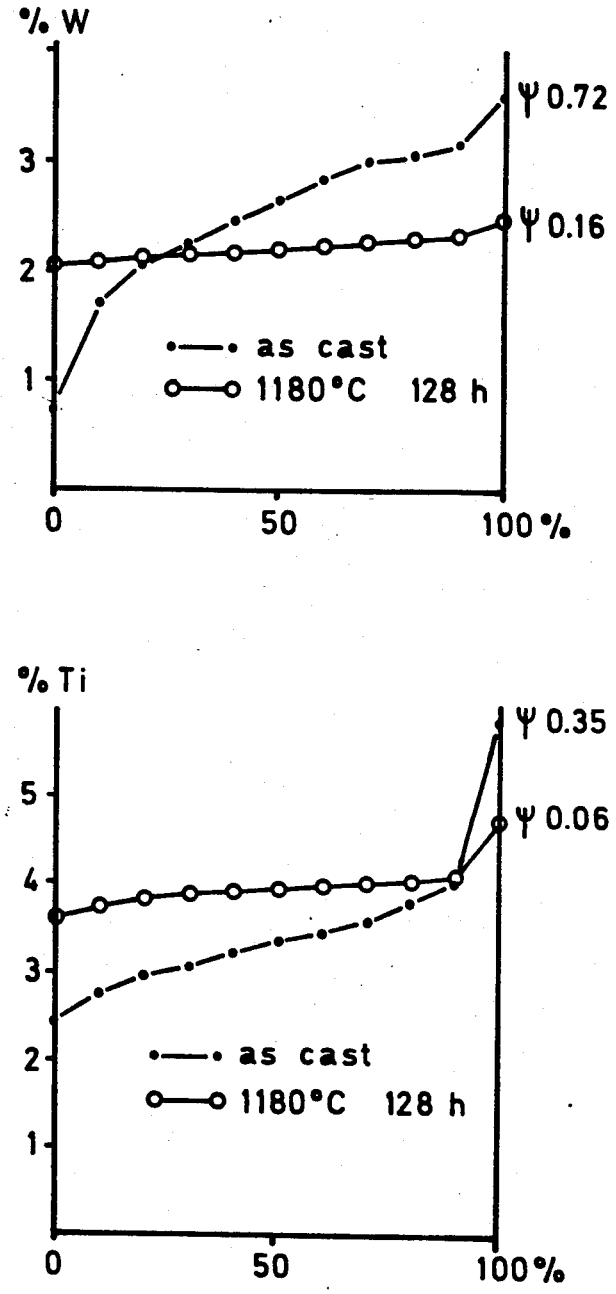
Figure 6:
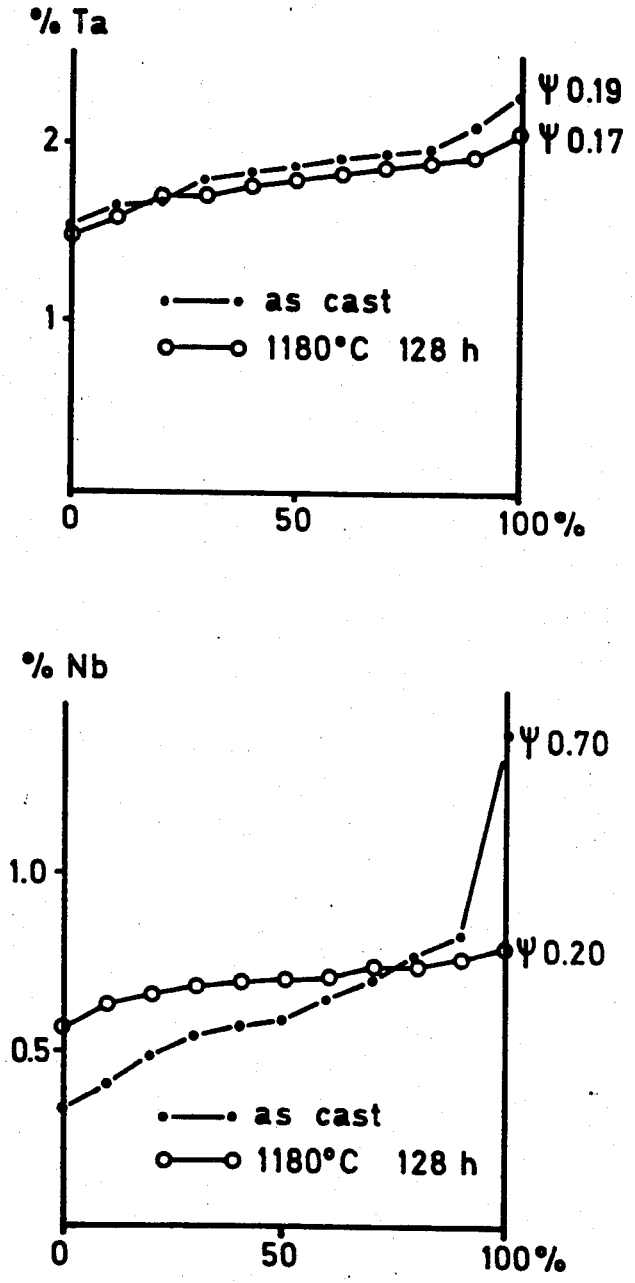

FIGS. 4–6 show an automated electron probe microanalysis of microsegregation in alloy IN 738 in the "as cast" condition and after homogenization heat treatment. Due to the three-dimensional concentration profile, line scans over certain areas randomly chosen are not very well controlled. The maximum or minimum concentration regions may not be passed and segregations indices out of line scan concentration profiles are hence not quantitative enough. A random sampling of point analyses and the cumulative frequency of the measured concentrations will give the most representative information of microsegregation. The diagrams taken from the results show a great difference in behavior of the elements. Co and Ni are homogenized already after casting and cooling and subsequent heat treatment doesn't significantly change the original as cast distribution. W, Ti and Nb are heavily segregated in the as cast condition, but homogenizing heat treatment causes the elements to distribute themselves evenly by diffusion.

Tantalum shows a different behavior, it is segregated after casting and cooling, but subsequent heat treatment does not generate much homogenization. This finding confirms that tantalum is present in high temperature stable phases as can be predicted by the binry phase diagrams, and therefore the conclusion can be drawn, that a tantalum rich layer on top of a Fe, Ni or Co high temperature alloy can form phases with the elements in the matrix which are resistant to interdiffusion.

The rig tests of FIG. 3 were carried out in burner rig at NPL Teddington, England up to 300 hours.

Coatings

1–2. CoCrAlY, low pressure plasma sprayed.
3–4. FeCrAlY (low Al). Oxides removed by remelting. Polished samples.
5. Same as 3–4 but unpolished samples.
6. Same as 3–4, tested 139 hours.
7. Same as 6, tested 308 hours.
8. FeCrAlY (high Al) remelted to remove oxides, end not protected, 220 hours.
9. Same as 8, end protected 308 hours.
10. FeCrAlY, (high Al) remelted.
11. FeCrAlY, (low Al) pores closed.
12. FeCrAlY, (high Al) pores closed.
13. FeCrAlY, physical vapour deposition.
14. FeCrAlY, physical vapour deposition under supply of oxygen.
15–16. Nickel-aluminide with platinum.
17. Uncoated matrix alloy IN 738.

I claim:

1. Process for preparing heat resistant and corrosion resistant materials by coating the material with an alloy of the type MCrAlY, where M is Fe, Ni, Co or NiCo, characterized in that the coating is formed by means of plasma spraying a powder of the alloy metals in the presence of a controlled supply of oxygen and that the plasma sprayed powder comprises an excess of Al and/or Cr and/or Y compared to the final alloy composition, whereby a certain amount of the powder is oxidized so that the resulting coating is of a dual phase structure consisting of a metal phase of the composition MCrAlY and oxide layers which are more or less parallel to the material surface preventing the diffusion of metals or heat in the thickness direction of the layers.

2. Process according to claim 1, characterized in that the oxygen is supplied as gas and/or oxide powder.

3. Process according to claim 1, characterized in that the plasma sprayed powder comprises at least 2% more of Al than the alloy constituting the metal phase of the produced coating.

4. Process according to claim 3, characterized in that the plasma sprayed powder comprises 7% of Al.

5. Process according to claim 1, characterized in that the produced coating is given a ceramic coating.

6. Process according to claim 1, characterized in that the plasma sprayed material is hot isostatically pressed in an encapsulated condition, which improves the adhesion and the diffusion density of the coating.

7. Process according to claim 1, characterized in that the material is given a tantalum layer before the plasma spraying.

8. Process according to claim 1, characterized in that ceramic materials are mixed into the power before the plasma spraying.

9. Process according to claim 1, characterized in that the metal phase of the coating formed by means of the plasma spraying consists of FeCrAlY.

10. Process according to claim 1, characterized in that the produced coating is given a ceramic coating of $ZrO_2$.

11. Process according to claim 1, characterized in that the plasma sprayed material after having been given a ceramic coating is hot isostatically pressed in an encapsulated condition, which improves the adhesion and the diffusion density of the coating.

* * * * *